US009284657B2

(12) United States Patent
Yoshida et al.

(10) Patent No.: US 9,284,657 B2
(45) Date of Patent: Mar. 15, 2016

(54) REPLENISHER AND METHOD FOR PRODUCING SURFACE-TREATED STEEL SHEET

(75) Inventors: Yuta Yoshida, Tokyo (JP); Hiroki Sunada, Tokyo (JP); Shigeki Yamamoto, Tokyo (JP); Hidehiro Yamaguchi, Tokyo (JP)

(73) Assignee: NIHON PARKERIZING CO., LTD., Chuo-ku, Tokyo (JP)

( * ) Notice: Subject to any disclaimer, the term of this patent is extended or adjusted under 35 U.S.C. 154(b) by 0 days.

(21) Appl. No.: 14/361,143

(22) PCT Filed: Nov. 30, 2011

(86) PCT No.: PCT/JP2011/077639

§ 371 (c)(1),
(2), (4) Date: Aug. 18, 2014

(87) PCT Pub. No.: WO2013/080325

PCT Pub. Date: Jun. 6, 2013

(65) Prior Publication Data

US 2015/0021192 A1 Jan. 22, 2015

(51) Int. Cl.

| | |
|---|---|
| ***C25D 9/10*** | (2006.01) |
| ***C25D 11/00*** | (2006.01) |
| ***C25D 9/08*** | (2006.01) |
| ***C25D 21/18*** | (2006.01) |

(52) U.S. Cl.
CPC .. *C25D 9/10* (2013.01); *C25D 9/08* (2013.01); *C25D 11/00* (2013.01); *C25D 21/18* (2013.01)

(58) Field of Classification Search
CPC ..... C25D 11/00; C25D 11/26; C25D 21/18; C25D 9/10
USPC ..... 205/101, 320, 333
See application file for complete search history.

(56) References Cited

U.S. PATENT DOCUMENTS

| | | | | |
|---|---|---|---|---|
| 7,883,616 | B2 * | 2/2011 | Shoji | C23C 22/34 205/316 |
| 2003/0075453 | A1 * | 4/2003 | Dolan | 205/324 |
| 2004/0244875 | A1 * | 12/2004 | Yasuda | C25D 9/08 148/247 |
| 2011/0259756 | A1 * | 10/2011 | Hirano et al. | 205/320 |

FOREIGN PATENT DOCUMENTS

| | | | |
|---|---|---|---|
| JP | 2005-344186 | A | 12/2005 |
| JP | 2006-161067 | A | 6/2006 |
| JP | 2009-084623 | A | 4/2009 |

OTHER PUBLICATIONS

International Search Report for PCT/JP2011/077639 (1 page).

* cited by examiner

*Primary Examiner* — Nicholas A Smith
*Assistant Examiner* — Brian W Cohen
(74) *Attorney, Agent, or Firm* — Flynn, Thiel, Boutell & Tanis, P.C.

(57) ABSTRACT

A replenisher which is capable of supplying Zr ions to a metal surface treatment solution, while suppressing an increase in the HF concentration in the metal surface treatment solution, so that a chemical conversion coating film can be continuously formed on a steel sheet by electrolysis and contains (A) zirconium hydrofluoric acid or a salt thereof and/or (B) hydrofluoric acid or a salt thereof and (C) a fluorine-free zirconium compound. The total concentration (g/l) of zirconium ions derived from the components (A) and (C) is 20 or more, and the ratio of the total molar amount ($M_F$) of the fluorine ions derived from the components (A) and (B) relative to the total molar amount ($M_{Zr}$) of the zirconium ions derived from the components (A) and (C), namely $M_F/M_{Zr}$ is 0.01 or more but less than 4.00.

6 Claims, No Drawings

REPLENISHER AND METHOD FOR PRODUCING SURFACE-TREATED STEEL SHEET

TECHNICAL FIELD

The present invention relates to a replenisher and a method for producing a surface-treated steel sheet.

BACKGROUND ART

In steel sheet products, a chromate coating has conventionally been formed on a surface of a steel sheet or a surface of an Sn, Zn, Ni or other coating formed by plating on the steel sheet in order to ensure the properties such as corrosion resistance, rust resistance and adhesion of a coating material.

In recent years, however, regulations limiting the use of hexavalent chromium have been considered with increasing interest in the environment and it is proposed to use a chemical conversion coating composed of a Zr compound as a new coating replacing the chromate coating. More specifically, a Zr-based chemical conversion coating having excellent performance can be obtained by carrying out electrolytic treatment (e.g., cathodic electrolytic treatment) in a metal surface treatment solution containing a zirconium (Zr) compound.

In the chemical conversion treatment method, successive production of a chemical conversion coating reduces the Zr ion concentration in the metal surface treatment solution containing a Zr compound. In order to solve this problem, Patent Literature 1 proposes a Zr ion-supplying method for consistently adhering a Zr-based chemical conversion coating to the surface of a steel sheet on a continuous electroplating line.

More specifically, as a result of electrolytic treatment in the metal surface treatment solution containing a Zr compound, hydrogen ions or the like are reduced in the vicinity of a cathode electrode to increase the pH of the solution in the vicinity of a steel sheet to be plated, whereby a coating of a Zr compound such as zirconium oxide is formed on the steel sheet. For instance, in a case where $H_2ZrF_6$ is used, the following reaction proceeds:

$$H_2ZrF_6+2H_2O \rightarrow ZrO_2+6HF \qquad \text{Formula (1)}$$

As shown in formula (1) above, this reaction produces HF as a by-product. Since the HF is not contained in the coating, the HF remains in the metal surface treatment solution and its concentration increases. Since HF is on the right side of formula (1), an increase in the amount of HF suppresses the reaction, making it difficult for a coating to be deposited. Then, an attempt has heretofore been made to keep the HF concentration at a constant level through automatic drainage of the metal surface treatment solution. However, from an environmental and economic point of view, it was not preferable for drainage water containing large amounts of Zr ions, HF and the like to be discharged at all times.

Then, Patent Literature 1 proposes that a fluorine-free Zr compound should be used in a predetermined amount to supply Zr ions to a metal surface treatment solution so that the above-mentioned problem can be solved.

CITATION LIST

Patent Literature

Patent Literature 1: JP 2009-84623 A

SUMMARY OF INVENTION

Technical Problems

As described above, hydrolysis of a Zr compound such as $H_2ZrF_6$ caused by a pH increase in the vicinity of a cathode electrode is a main reaction in the formation of a chemical conversion coating. That is, the pH of a metal surface treatment solution containing a Zr compound has a large influence on the reactivity.

In general, the treatment pH of a metal surface treatment solution containing a Zr compound such as $H_2ZrF_6$ is in many cases adjusted in a range of around 3.0 to 4.0 in order to improve the deposition properties of a chemical conversion coating.

On the other hand, fluorine-free Zr compounds such as zirconium nitrate and zirconium sulfate which contain no fluorine often have a precipitation equilibrium pH of around 2, and Zr is deposited and precipitated as soon as the fluorine-free Zr compounds are supplied to a metal surface treatment solution having a pH in the foregoing range. In other words, according to the method in Patent Literature 1, Zr ions could not be supplied to a metal surface treatment solution containing a Zr compound depending on the type of the treatment solution.

A compound solubilized by an organic chelating agent is also known as a Zr compound. However, the chelate stability constant of a common organic chelating agent shows stability in a high pH range. A chemical conversion coating is not easily deposited at an increased pH and the chelating agent remains in a metal surface treatment solution in the same way as the HF. Accordingly, when being continuously added to the metal surface treatment solution, the compound accumulates in the metal surface treatment solution to reduce the deposition properties of a chemical conversion coating.

In addition, although it is desirable to prepare a solution having a high Zr ion concentration as a replenisher, a solution having a low fluorine ion concentration and a high Zr ion concentration is difficult to prepare and the solution could not be produced in a conventional technique.

In view of the situation as described above, an object of the present invention is to provide a replenisher capable of supplying Zr ions to a metal surface treatment solution while suppressing an increase in the HF concentration in the metal surface treatment solution such that a chemical conversion coating can be continuously formed on steel sheets by electrolytic treatment.

Another object of the present invention is to provide a method for producing a surface-treated steel sheet using the replenisher.

Solution to Problems

The inventors of the invention have made an intensive study, and as a result found that the above-described problems can be solved by using a replenisher having a high Zr ion concentration which is obtained with the use of predetermined compounds.

Accordingly, the inventors of the invention have found that the problems can be solved by the characteristic features as described below.

(1) A replenisher for use in supplying zirconium ions to a metal surface treatment solution which contains zirconium ions and fluorine ions and which is used to form, on a surface of a steel sheet, a zirconium-containing chemical conversion coating through electrolytic treatment, comprising:

(A) hexafluorozirconic acid or a salt thereof; and/or (B) hydrofluoric acid or a salt thereof; and (C) a fluorine-free zirconium compound, wherein a total concentration (g/L) of the zirconium ions derived from the hexafluorozirconic acid or a salt thereof (A) and the fluorine-free zirconium compound (C) is at least 20, and wherein a ratio ($M_F/M_{Zr}$) of a total molar quantity of the fluorine ions ($M_F$) derived from the hexafluorozirconic acid or a salt thereof (A) and the hydrofluoric acid or a salt thereof (B) to a total molar quantity of the zirconium ions ($M_{Zr}$) derived from the hexafluorozirconic acid or a salt thereof (A) and the fluorine-free zirconium compound (C) is 0.01 or more but less than 4.00.

(2) The replenisher according to (1) having a pH of at least 0 but less than 4.0.

(3) The replenisher according to (1) or (2), wherein the fluorine-free zirconium compound (C) is at least one selected from the group consisting of zirconium oxynitrate, zirconium oxysulfate, zirconium acetate, zirconium hydroxide, and basic zirconium carbonates.

(4) A method for producing a surface-treated steel sheet comprising: continuously electrolyzing a steel sheet in a metal surface treatment solution containing zirconium ions and fluorine ions to form a zirconium-containing chemical conversion coating on the steel sheet, wherein the replenisher according to any one of (1) to (3) is added to the metal surface treatment solution to supply zirconium ions.

Advantageous Effects of Invention

The present invention can provide a replenisher capable of supplying Zr ions to a metal surface treatment solution while suppressing an increase in the HF concentration in the metal surface treatment solution such that a chemical conversion coating can be continuously formed on steel sheets by electrolytic treatment.

The present invention can also provide a method for producing a surface-treated steel sheet using the replenisher.

DESCRIPTION OF EMBODIMENTS

A replenisher according to this embodiment is described below.

The replenisher according to this embodiment contains zirconium (hereinafter also referred to as "Zr") ions at a high concentration and the ratio ($M_F/M_{Zr}$) of the total molar quantity of fluorine ions ($M_F$) to the total molar quantity of zirconium ions ($M_{Zr}$) is very small. In other words, the replenisher contains Zr ions at a higher concentration compared to fluorine ions. Accordingly, in a case where the replenisher is mixed with a metal surface treatment solution, a large amount of Zr ions can be supplied while suppressing the increase of HF. As a result, steel sheets can be subjected to continuous chemical conversion treatment without frequent automatic drainage.

The replenisher according to this embodiment can be produced with a high productivity by a production method which involves a heating treatment to be described later and which uses (A) hexafluorozirconic acid or a salt thereof and/or (B) hydrofluoric acid or a salt thereof and (C) a fluorine-free zirconium compound.

The replenisher according to this embodiment is first described in detail below and a method for producing a steel sheet which uses the replenisher and involves chemical conversion treatment is then described in detail.

Replenisher

The replenisher is used to mainly supply Zr ions to a metal surface treatment solution which contains Zr ions and fluorine ions and which is used to form, on a surface of a steel sheet, a chemical conversion coating containing zirconium as its main component through electrolytic treatment.

Various materials contained in the replenisher are first described in detail and a method for producing the replenisher is then described in detail.

(Hexafluorozirconic Acid or Salt Thereof (A))

The hexafluorozirconic acid or a salt thereof (A) (hereinafter also referred to simply as "hexafluorozirconic acid (A)") is a zirconium-containing compound represented by $H_2ZrF_6$ or a metallic acid salt (e.g., sodium salt, potassium salt, lithium salt or ammonium salt) as exemplified by $Na_2ZrF_6$. In other words, the hexafluorozirconic acid (A) is at least one selected from the group consisting of hexafluorozirconic acid and salts thereof. Such compounds supply Zr ions and F ions to the replenisher. Hexafluorozirconic acid may be used in combination with a salt thereof.

(Hydrofluoric Acid or Salt Thereof (B))

The hydrofluoric acid or a salt thereof (B) (hereinafter also referred to simply as "hydrofluoric acid (B)") is a compound represented by HF or a salt thereof. In other words, the hydrofluoric acid (B) is at least one selected from the group consisting of hydrofluoric acid and salts thereof. Exemplary hydrofluoric acid salts include salts obtained from hydrofluoric acid and bases (e.g., amine compounds), preferably metal-free bases. Such compounds supply F ions to the replenisher. Hydrofluoric acid may be used in combination with a salt thereof.

The replenisher contains at least one of the hexafluorozirconic acid (A) and the hydrofluoric acid (B). The replenisher may contain both of them.

(Fluorine-Free Zirconium Compound (C))

The fluorine-free zirconium compound (C) is a compound which does not contain a fluorine atom but contains a Zr atom. This compound supplies Zr ions to the replenisher.

The type of the fluorine-free zirconium compound (C) is not particularly limited, and examples thereof include zirconium oxynitrate, zirconium oxysulfate, zirconium acetate, zirconium hydroxide, basic zirconium carbonates (ammonium zirconium carbonate, lithium zirconium carbonate, sodium zirconium carbonate, potassium zirconium carbonate, zirconium hydroxide) and zirconium oxychloride. Of these, zirconium oxysulfate, zirconium acetate, zirconium hydroxide and basic zirconium carbonates are preferable in terms of more excellent long-term stability of the replenisher.

(Contents of Various Components)

The total concentration (g/L) of zirconium (Zr) ions derived from the hexafluorozirconic acid (A) and the fluorine-free zirconium compound (C) in the replenisher is at least 20. When the total concentration is within the above range, a chemical conversion coating can be formed continuously and consistently. In particular, the total Zr ion concentration (g/L) is preferably at least 25 and more preferably at least 40 because the amount of chemicals used is small and the operational economy is more excellent. The upper limit is not particularly limited but is 80 or less in many cases, in terms of solubility of the hexafluorozirconic acid (A) and the fluorine-free zirconium compound (C).

When the total Zr ion concentration (g/L) is less than 20, because of a low concentration of the replenisher, excessive water is supplied as a result of supply of the replenisher, which increases the volume of the metal surface treatment solution and consequently automatic drainage of the metal surface treatment solution is necessary in order to carry out electrolytic treatment as a continuous process and hence the objects of the invention cannot be achieved.

The ratio ($M_F/M_{Zr}$) of the total molar quantity of fluorine ions ($M_F$) derived from the hexafluorozirconic acid (A) and the hydrofluoric acid (B) to the total molar quantity of zirconium ions ($M_{Zr}$) derived from the hexafluorozirconic acid (A)

and the fluorine-free zirconium compound (C) is 0.01 or more but less than 4.00. When the ratio is within the above range, a chemical conversion coating can be formed in a consistent manner without increasing the concentration of HF in the metal surface treatment solution. Particularly in a continuous strip line in which the amount of metal surface treatment solution transferred is small as compared to that in a tact processing line for processing shaped workpieces, it is more important to further reduce the amount of fluorine ions supplied. In view of this, the ratio ($M_F/M_{Zr}$) is preferably at least 1.9 but less than 4.00 and more preferably 2.8 to 3.2.

At a ratio ($M_F/M_{Zr}$) of less than 0.01, it is necessary for the pH of the replenisher to be kept at a very low level to dissolve a large amount of Zr ions, and as a result of mixing of the replenisher with a metal surface treatment solution having a higher pH than the replenisher, Zr ions in the replenisher does not dissolve in the metal surface treatment solution but forms a large amount of deposits, whereby additional Zr ions in an amount corresponding to Zr ions consumed and decreased from the metal surface treatment solution cannot be supplied. At a ratio ($M_F/M_{Zr}$) of 4.00 or more, continuous use of the replenisher increases the HF concentration in the metal surface treatment solution and hence automatic drainage is necessary in order to form a chemical conversion coating in a consistent manner and the objects of the invention cannot be achieved as above.

The content of the hexafluorozirconic acid (A) in the replenisher is preferably 0.5 to 80 parts by mass and more preferably 30 to 75 parts by mass with respect to 100 parts by mass of the fluorine-free zirconium compound (C) in terms of more excellent deposition efficiency of the chemical conversion coating.

The content of the hydrofluoric acid (B) in the replenisher is preferably 5 to 60 parts by mass and more preferably 7 to 50 parts by mass with respect to 100 parts by mass of the fluorine-free zirconium compound (C) in terms of more excellent deposition efficiency of the chemical conversion coating.

The pH of the replenisher is not particularly limited and is preferably 0 to 4.0 and more preferably 0 to 1.5 in terms of excellent stability of the replenisher.

The replenisher may optionally contain a solvent. The type of the solvent to be used is not particularly limited and water and/or an organic solvent may be used.

An example of the organic solvent includes an alcoholic solvent. The content of the organic solvent should be in such a range that the stability of the replenisher and the stability of the metal surface treatment solution to be supplied with the replenisher are not impaired and the organic solvent is preferably not used in terms of working environment.

In the case where the replenisher contains a solvent, the total mass of the hexafluorozirconic acid (A), hydrofluoric acid (B) and fluorine-free zirconium compound (C) is preferably 2 to 90 mass % and more preferably 5 to 80 mass % with respect to the total amount of the replenisher in terms of more excellent deposition efficiency of the chemical conversion coating.

(Method for Producing Replenisher)

The method for producing the replenisher is not particularly limited as long as the replenisher according to the above-described embodiment can be obtained, and a production method which implements the following steps is preferable in terms of more excellent productivity of the replenisher containing Zr ions at a high concentration.

(1) A step which includes mixing the fluorine-free zirconium compound (C), a solvent and an acid component to prepare a solution X;

(2) A step which includes mixing the solution X with an alkaline component to prepare a solution Y containing deposits; and (3) A step which includes mixing the solution Y with the hexafluorozirconic acid (A) and/or the hydrofluoric acid (B), and then subjecting the resulting mixture to heating treatment to obtain the replenisher.

The procedure of each step is described in detail below.

(Step (1))

Step (1) is a step which includes mixing the fluorine-free zirconium compound (C), a solvent and an acid component to prepare a solution X. The fluorine-free zirconium compound (C) to be used is as described above. City water or deionized water is usually used as the solvent for use in this step.

The fluorine-free zirconium compound (C) is added to a solvent and stirred, and an acid component (e.g., hydrochloric acid, sulfuric acid or nitric acid) is further added to make the pH acidic. The solution X preferably has a pH of up to 4.0 and more preferably up to 1.5 because the fluorine-free zirconium compound (C) thereafter has more excellent solubility.

The content of the fluorine-free zirconium compound (C) in the solution X is not particularly limited and is preferably from 2 to 85 mass % and more preferably from 5 to 80 mass % with respect to the total amount of the solution X in terms of stability in the pH of the replenisher.

(Step (2))

Step (2) is a step which includes mixing the solution X with an alkaline component to prepare a solution Y containing deposits. Through this step, Zr ions dissolved in the solution X are once deposited with the alkaline component. The type of the alkaline component that may be used is not particularly limited and examples thereof include alkali metal hydroxides such as sodium hydroxide and potassium hydroxide; alkaline-earth metal hydroxides such as calcium hydroxide and magnesium hydroxide; ammonia; and organic amines such as monoethanolamine, diethanolamine and triethanolamine.

There is no particular limitation on the method for mixing the solution X with the alkaline component and exemplary methods include a method which involves adding the alkaline component to the solution X and stirring the resulting mixture, and a method which involves once dissolving the alkaline component in a solvent and adding the solution X thereto.

The amount of the alkaline component to be mixed with the solution X is not particularly limited and the alkaline component is used until Zr-containing deposits appear. More specifically, the solution Y (solution obtained by mixing the solution X with the alkaline component) preferably has a pH of at least 5 and more preferably at least 7 in that Zr-containing deposits can be deposited more efficiently. The upper limit is not particularly limited and is often up to 8 in many cases in consideration of the economic viewpoint and accumulation of the alkaline component. Step (2) may be omitted if stable mixing with the hexafluorozirconic acid (A) and/or the hydrofluoric acid (B) in Step (3) is possible.

(Step (3))

Step (3) is a step which includes mixing the solution Y (or the solution X) with the hexafluorozirconic acid (A) and/or the hydrofluoric acid (B), and then subjecting the resulting mixture to heating treatment. Through this step, the deposits formed in Step (2) dissolve in the solution again, whereby the replenisher having a high Zr ion concentration can be obtained.

Embodiments of the hexafluorozirconic acid (A) and the hydrofluoric acid (B) to be used are as described above. The hexafluorozirconic acid (A) and the hydrofluoric acid (B) are used in such amounts that the various concentrations in the above-described replenisher are obtained.

There is no particular limitation on the method for mixing the solution Y with the hexafluorozirconic acid (A) and/or the hydrofluoric acid (B) and exemplary methods include a method which involves adding the hexafluorozirconic acid (A) and/or the hydrofluoric acid (B) to the solution Y and stirring the resulting mixture, and a method which involves once dissolving the hexafluorozirconic acid (A) and/or the hydrofluoric acid (B) in a solvent and adding the solution Y thereto.

Heating conditions during the heating treatment are not particularly limited and include a heating temperature of preferably 40 to 70° C. and more preferably 50 to 60° C. in terms of more excellent solubility.

The heating time is preferably from 30 minutes to 2 hours, and more preferably from 30 minutes to 1 hour in terms of more excellent productivity of the replenisher.

An acid component or an alkaline component may be optionally added after the above-described heating treatment to adjust the pH of the resulting replenisher. The pH range is as described above.

For example, in a case where a basic zirconium carbonate is used as the fluorine-free zirconium compound (C), another exemplary method for producing the replenisher includes a method which involves preparing a solution containing a basic zirconium carbonate, mixing the solution with the hexafluorozirconic acid (A) and/or the hydrofluoric acid (B), adding an acid component (e.g., hydrochloric acid, sulfuric acid or nitric acid) to carry out the above-described heating treatment.

Method for Producing Surface-Treated Steel Sheet

The method for producing a surface-treated steel sheet with the use of the replenisher is described below in detail.

The method for producing a surface-treated steel sheet is a method which includes continuously electrolyzing a steel sheet in a metal surface treatment solution containing zirconium ions and fluorine ions to form a zirconium-containing chemical conversion coating (film formed by electrolysis) on the steel sheet.

The metal surface treatment solution that may be used in the method for producing a surface-treated steel sheet is first described in detail and a detailed description is then given on how to use the replenisher in the production method.

(Metal Surface Treatment Solution)

The metal surface treatment solution that may be used in the method for producing a surface-treated steel sheet contains zirconium ions and fluorine ions. The zirconium ion (Zr ion) in the metal surface treatment solution refers to both (1) a complex zirconium fluoride ion represented by $ZrFn^{(4-n)}$ in which 1 to 6 mol of fluorine is coordinated to 1 mol of zirconium and (2) a zirconium ion or a zirconyl ion derived from a zirconium or zirconyl of an inorganic acid such as zirconyl nitrate or zirconyl sulfate or from a zirconium or zirconyl of an organic acid such as zirconium acetate or zirconyl acetate. The fluorine ion in the metal surface treatment solution refers to both a fluorine ion ($F^-$) present in the metal surface treatment solution and fluorine in a fluorine-containing complex ion such as a complex zirconium fluoride ion, the total fluorine concentration to be mentioned below refers to a total amount of the fluorine ions and the fluorine in the fluorine-containing complex ions, and the free fluorine concentration refers to a total amount of the fluorine ions ($F^-$).

The content of Zr ions in the metal surface treatment solution is not particularly limited and a suitable value is appropriately selected depending on the type of a steel sheet to be used and the properties of a chemical conversion coating to be formed. In particular, the Zr ion content is preferably in a range of 0.500 to 10.000 g/L and more preferably 1.000 to 2.000 g/L in terms of more excellent stability of the metal surface treatment solution and also excellent deposition efficiency of the chemical conversion coating.

Exemplary supply sources of Zr ions include the above-described hexafluorozirconic acid (A) and fluorine-free zirconium compound (C).

The content of fluorine in the metal surface treatment solution is not particularly limited and a suitable value is appropriately selected depending on the type of a steel sheet to be used and the properties of an electrolytic coating to be formed. In particular, the total fluorine concentration is preferably in a range of 0.500 to 10.000 g/L and more preferably 1.000 to 3.000 g/L in terms of more excellent stability of the metal surface treatment solution and also excellent deposition efficiency of the chemical conversion coating. The free fluorine ion concentration is preferably in a range of 50 mg/L to 400 mg/L and more preferably 75 to 250 mg/L.

A known fluorine-containing compound (compound containing fluorine) is used as a supply source of fluorine ions. Examples of the fluorine-containing compound include hydrofluoric acid and its ammonium salt and alkali metal salts; metal fluorides such as tin fluoride, manganese fluoride, ferrous fluoride, ferric fluoride, aluminum fluoride, zinc fluoride, and vanadium fluoride; and acid fluorides such as fluorine oxide, acetyl fluoride and benzoyl fluoride.

A compound having at least one element selected from the group consisting of Ti, Zr, Hf, Si, Al and B atoms is advantageously used as the fluorine-containing compound. Specific examples thereof include complexes in which 1 to 3 hydrogen atoms are added to anions such as $(TiF_6)^{2-}$, $(ZrF_6)^{2-}$, $(HfF_6)^{2-}$, $(SiF_6)^{2-}$, $(AlF_6)^{3-}$, and $(BF_4OH)^-$, ammonium salts of these anions and metal salts of these anions.

The contents (concentrations) of the Zr ions and fluorine ions in the metal surface treatment solution can be determined by, for example, atomic absorption spectrometry, ICP emission spectrometry or ion chromatography analysis.

The pH of the metal surface treatment solution is appropriately adjusted depending on the steel sheet to be used and the electrolytic treatment conditions and is preferably in a range of about 2.5 to about 5.0 and more preferably about 3 to about 4 in terms of more excellent deposition properties of the chemical conversion coating.

(Steel Sheet)

The type of the steel sheet to be used is not particularly limited and a known steel sheet can be used. Exemplary steel sheets include commonly known metal materials and plated sheets such as a cold-rolled steel sheet, a hot-rolled steel sheet, a tin electroplated steel sheet, a hot-dip galvanized steel sheet, an electrogalvanized steel sheet, an alloyed hot-dip galvanized steel sheet, an aluminum plated steel sheet, an aluminum-zinc alloy plated steel sheet, a stainless steel sheet, an aluminum sheet, a copper sheet, a titanium sheet, and a magnesium sheet.

(Electrode Treatment)

Electrolytic treatment (anodic electrolytic treatment, cathodic electrolytic treatment) using the above-described metal surface treatment solution can be carried out under known conditions with the use of known electrolytic equipment.

For instance, the current density is preferably in a range of 0.1 to 10.0 A/dm$^2$ and more preferably 0.5 to 5.0 A/dm$^2$ in terms of more excellent deposition efficiency of the chemical conversion coating.

The coating weight of the chemical conversion coating formed is appropriately adjusted but is usually in a range of about 1 to about 30 mg/m$^2$ in many cases in terms of more excellent properties of the chemical conversion coating.

(Mode of Use of Replenisher)

In a case where the above-described method for producing a surface-treated steel sheet is continuously carried out, the concentration of the Zr ions in the metal surface treatment solution decreases. Then, the above-described replenisher is added to the metal surface treatment solution in order to compensate for the decrease of the Zr ions.

The period for adding the replenisher to the metal surface treatment solution is not particularly limited and the replenisher is appropriately added when necessary. In many cases, the ratio ($M_F/M_{Zr}$) of the molar quantity of the fluorine ions ($M_F$) to the molar quantity of the zirconium ions ($M_{Zr}$) in the metal surface treatment solution is controlled in a range of about 6.0 to about 15.0 in order to deposit a predetermined chemical conversion coating on a steel sheet with a high efficiency. Then, in a case where the ratio ($M_F/M_{Zr}$) in the metal surface treatment solution departs from the above range, the replenisher is preferably added so that the ratio ($M_F/M_{Zr}$) may return to the above range.

When the replenisher is added to the metal surface treatment solution, a predetermined amount of the replenisher may be added all at once or in several divided portions.

The replenisher may be added to the metal surface treatment solution in the course of implementing the method for producing a surface-treated steel sheet or after the production method is once stopped.

EXAMPLES

The present invention is described below by referring to specific examples. However, the present invention should not be construed as being limited to the following examples.

Testing Material

Materials used as testing materials are as follows:

(1) A cold-rolled steel sheet (SPC) with a sheet thickness of 0.8 mm;

(2) A hot-dip galvanized steel sheet (GI) with a sheet thickness of 0.6 mm;

(3) A tin electroplated steel sheet (having undergone reflow treatment) (ET) with a sheet thickness of 0.3 mm; and (4) A nickel electroplated steel sheet (NI) with a sheet thickness of 0.3 mm.

Pretreatment

The testing materials were degreased by a 2-minute immersion in an alkaline degreasing agent (FINECLEANER 4386 manufactured by Nihon Parkerizing Co., Ltd.; concentration of the prepared solution: 2%; 60° C.) and then rinsed with tap water and ion-exchanged water. The water was removed with draining rolls and the testing materials were dried by a dryer and used.

<Comparative Test 1>

A metal surface treatment solution having a Zr concentration of 1,500 mg/L (supply source: $H_2ZrF_6$), an HF concentration of 150 mg/L and an $HNO_3$ concentration of 8,000 mg/L (total F concentration in the metal surface treatment solution: 2,025 mg/L; pH: 3.5; total amount: 10 L) was heated to 50° C., and a Ti/Pt electrode and a sample of the testing material (1) were used as the anode and the cathode, respectively, to carry out electrolytic treatment at 0.5 A/dm$^2$ for 5 seconds (the sample was immersed in the cell as a current was applied thereto) to thereby obtain a surface-treated steel sheet in which a chemical conversion coating having a Zr coating weight of about 10 mg/m$^2$ was formed. Then, without supplying Zr to the metal surface treatment solution, a new sample of the testing material (1) was prepared and the operation for carrying out the electrolytic treatment was repeated. The Zr coating weight and the appearance of the metal surface treatment solution with respect to the treatment load scaled in increments of 0.5 m$^2$/L are shown in Table 1.

The treatment load refers to a value (A/B) obtained by dividing the integrated value (A m$^2$) of the total area of both main surfaces of a treated testing material sample by the total amount (B L) of a metal surface treatment solution and this value increases with an increasing number of testing material samples to be treated. More specifically, in a case where three testing material samples, each having a total area of A m$^2$, are prepared for a metal surface treatment solution having a total amount of B L and the above-described electrolytic treatment is repeated three times, the treatment load is calculated as {(A/B)×3}.

The amount of metal surface treatment solution transferred when a sample of the testing material (1) was taken out from the metal surface treatment solution after electrolytic treatment was carried out once was adjusted to be 10 mL/m$^2$ and 10 mL/m$^2$ of water was supplied to the metal surface treatment solution each time the treatment load increases by a value of 0.5 L/m$^2$ to thereby keep the solution amount.

The amount (mL/m$^2$) of metal surface treatment solution transferred refers to a value obtained by dividing the amount (mL) of solution transferred by the total area of both the main surfaces of a testing material sample.

TABLE 1-1

| | Treatment load m$^2$/L | | | | | | | | | | |
|---|---|---|---|---|---|---|---|---|---|---|---|
| | 0.0 | 0.5 | 1.0 | 1.5 | 2.0 | 2.5 | 3.0 | 3.5 | 4.0 | 4.5 | 5.0 |
| Zr coating weight mg/m$^2$ | 10.1 | 9.7 | 11.3 | 10.9 | 9.6 | 9.6 | 10.3 | 9.6 | 9.8 | 9.4 | 9.2 |
| Appearance of treatment solution | Transparent | Transparent | Transparent | Transparent | Transparent | Transparent | Transparent | Transparent | Transparent | Transparent | Transparent |

TABLE 1-2

| | Treatment load $m^2/L$ | | | | | | | | | |
|---|---|---|---|---|---|---|---|---|---|---|
| | 5.5 | 6.0 | 6.5 | 7.0 | 7.5 | 8.0 | 8.5 | 9.0 | 9.5 | 10 |
| Zr coating weight $mg/m^2$ | 8.8 | 2.7 | 1.9 | 3.1 | 3.1 | 2.4 | 1.3 | 2.2 | 3.1 | 2.0 |
| Appearance of treatment solution | Trans-parent | Trans-parent | Trans-parent | Trans-parent | Trans-parent | Trans-parent | Trans-parent | Trans-parent | Trans-parent | Trans-parent |

<Comparative Test 2>

A metal surface treatment solution having a Zr concentration of 1,500 mg/L (supply source: $H_2ZrF_6$), an HF concentration of 150 mg/L and an $HNO_3$ concentration of 8,000 mg/L (total F concentration in the metal surface treatment solution: 2,025 mg/L; pH: 3.5; total amount: 10 L) was heated to 50° C., and a Ti/Pt electrode and a sample of the testing material (2) were used as the anode and the cathode, respectively, to carry out electrolytic treatment at 0.5 $A/dm^2$ for 5 seconds (the sample was immersed in the cell as a current was applied thereto) to thereby obtain a surface-treated steel sheet in which a chemical conversion coating having a Zr coating weight of about 10 $mg/m^2$ was formed. Next, after the end of electrolytic treatment, $H_2ZrF_6$ was added to the metal surface treatment solution to replenish so as to maintain the Zr ion concentration (hereinafter also referred to as "Zr concentration"). Then, a new sample of the testing material (2) was prepared and a series of operations for carrying out the foregoing electrolytic treatment and its subsequent replenishment was repeated. The Zr coating weight and the appearance of the metal surface treatment solution with respect to the treatment load scaled in increments of 0.5 $m^2/L$ are shown in Table 2.

The amount of metal surface treatment solution transferred when a sample of the testing material (2) was taken out from the metal surface treatment solution after electrolytic treatment was carried out once was adjusted to be 10 $mL/m^2$ and the replenisher and/or water was added so that the total amount of the replenished metal surface treatment solution was kept constant.

TABLE 2-1

| | Treatment load $m^2/L$ | | | | | | | | | | |
|---|---|---|---|---|---|---|---|---|---|---|---|
| | 0.0 | 0.5 | 1.0 | 1.5 | 2.0 | 2.5 | 3.0 | 3.5 | 4.0 | 4.5 | 5.0 |
| Zr coating weight $mg/m^2$ | 10.2 | 10.6 | 8.5 | 2.1 | 1.8 | 1.4 | 1.7 | 2.0 | 1.5 | 0.9 | 1.1 |
| Appearance of treatment solution | Trans-parent | Trans-parent | Trans-parent | Trans-parent | Trans-parent | Trans-parent | Trans-parent | Trans-parent | Trans-parent | Trans-parent | Trans-parent |

TABLE 2-2

| | Treatment load $m^2/L$ | | | | | | | | | |
|---|---|---|---|---|---|---|---|---|---|---|
| | 5.5 | 6.0 | 6.5 | 7.0 | 7.5 | 8.0 | 8.5 | 9.0 | 9.5 | 10.0 |
| Zr coating weight $mg/m^2$ | 1.2 | 0.8 | 0.7 | 0.7 | 1.0 | 0.8 | 0.5 | 0.9 | 0.5 | 0.7 |
| Appearance of treatment solution | Trans-parent | Trans-parent | Trans-parent | Trans-parent | Trans-parent | Trans-parent | Trans-parent | Trans-parent | Trans-parent | Trans-parent |

<Comparative Test 3>

A metal surface treatment solution having a Zr concentration of 1,500 mg/L (supply source: $H_2ZrF_6$), an HF concentration of 150 mg/L and an $HNO_3$ concentration of 8,000 mg/L (total F concentration in the metal surface treatment solution: 2,025 mg/L; pH: 3.5; total amount: 10 L) was heated to 50° C., and a Ti/Pt electrode and a sample of the testing material (3) or (4) were used as the anode and the cathode, respectively, to carry out electrolytic treatment at 0.5 $A/dm^2$ for 5 seconds (the sample was immersed in the cell as a current was applied thereto) to thereby obtain a surface-treated steel sheet in which a chemical conversion coating having a Zr coating weight of about 10 $mg/m^2$ was formed.

Next, after the end of electrolytic treatment, $ZrO(NO_3)_2$ was added to the metal surface treatment solution to replenish it so as to maintain the Zr concentration. Then, a new sample of the testing material (3) or (4) was prepared and a series of operations for carrying out the foregoing electrolytic treatment and its subsequent replenishment was repeated. The Zr coating weight and the appearance of the metal surface treatment solution with respect to the treatment load scaled in increments of 0.5 $m^2/L$ in the case of using the samples of the testing material (3) are shown in Table 3. The amount of metal surface treatment solution transferred when a sample of the testing material (3) or (4) was taken out from the metal surface treatment solution after electrolytic treatment was carried out once was adjusted to be 10 $mL/m^2$ and the replenisher and/or water was added so that the total amount of the replenished metal surface treatment solution was kept constant.

Also in the case of using the samples of the testing material (4), it was shown as in Table 3 that the Zr coating weight tended to decrease with increasing treatment load and the appearance of the metal surface treatment solution tended to get cloudy.

TABLE 3-1

| | Treatment load $m^2/L$ | | | | | | | | | | |
|---|---|---|---|---|---|---|---|---|---|---|---|
| | 0.0 | 0.5 | 1.0 | 1.5 | 2.0 | 2.5 | 3.0 | 3.5 | 4.0 | 4.5 | 5.0 |
| Zr coating weight $mg/m^2$ | 9.8 | 10.2 | 10.7 | 10.4 | 10.4 | 10.8 | 10.7 | 9.2 | 8.4 | 4.1 | 2.6 |
| Appearance of treatment solution | Transparent | Cloudy | Cloudy | Cloudy | Cloudy | Cloudy | Cloudy | Cloudy | Cloudy | Cloudy | Cloudy |

TABLE 3-2

| | Treatment load $m^2/L$ | | | | | | | | | |
|---|---|---|---|---|---|---|---|---|---|---|
| | 5.5 | 6.0 | 6.5 | 7.0 | 7.5 | 8.0 | 8.5 | 9.0 | 9.5 | 10.0 |
| Zr coating weight $mg/m^2$ | 3.2 | 0.7 | 1.2 | 0.5 | 0.2 | 0.0 | 0.5 | 0.1 | 0.2 | 0.4 |
| Appearance of treatment solution | Cloudy | Cloudy | Cloudy | Cloudy | Cloudy | Cloudy | Cloudy | Cloudy | Cloudy | Cloudy |

<Comparative Test 4>

A metal surface treatment solution having a Zr concentration of 1,500 mg/L (supply source: $H_2ZrF_6$), an HF concentration of 150 mg/L and an $HNO_3$ concentration of 8,000 mg/L (total F concentration in the metal surface treatment solution: 2,025 mg/L; pH: 3.5; total amount: 10 L) was heated to 50° C., and a Ti/Pt electrode and a sample of the testing material (3) or (4) were used as the anode and the cathode, respectively, to carry out electrolytic treatment at 0.5 $A/dm^2$ for 5 seconds (the sample was immersed in the cell as a current was applied thereto) to thereby obtain a surface-treated steel sheet in which a chemical conversion coating having a Zr coating weight of about 10 $mg/m^2$ was formed. Next, by reference to the method described in [0033] of Patent Literature 1, the total F concentration in the metal surface treatment solution was first adjusted with $H_2ZrF_6$ and then Zr reduced in the metal surface treatment solution was added in the form of $ZrO(NO_3)_2$, whereby replenishment was carried out so as to maintain the Zr concentration and the total F concentration in the metal surface treatment solution. Then, a new sample of the testing material (3) or (4) was prepared and a series of operations for carrying out the foregoing electrolytic treatment and its subsequent replenishment was repeated. The Zr coating weight and the appearance of the metal surface treatment solution with respect to the treatment load scaled in increments of 0.5 $m^2/L$ in the case of using the samples of the testing material (3) are shown in Table 4.

The amount of metal surface treatment solution transferred when a sample of the testing material (3) or (4) was taken out from the metal surface treatment solution after electrolytic treatment was carried out once was adjusted to be 10 mL/$m^2$ and the replenisher and/or water was added so that the total amount of the replenished metal surface treatment solution was constant.

Also in the case of using the samples of the testing material (4), it was shown as in Table 4 that the Zr coating weight tended to decrease with increasing treatment load and the appearance of the metal surface treatment solution tended to get cloudy.

TABLE 7

TABLE 4-1

| | Treatment load $m^2$/L | | | | | | | | | | |
|---|---|---|---|---|---|---|---|---|---|---|---|
| | 0.0 | 0.5 | 1.0 | 1.5 | 2.0 | 2.5 | 3.0 | 3.5 | 4.0 | 4.5 | 5.0 |
| Zr coating weight mg/$m^2$ | 10.3 | 9.8 | 9.4 | 9.7 | 9.3 | 9.0 | 8.8 | 8.8 | 9.2 | 9.1 | 8.5 |
| Appearance of treatment solution | Transparent | Cloudy | Cloudy | Cloudy | Cloudy | Cloudy | Cloudy | Cloudy | Cloudy | Cloudy | Cloudy |

TABLE 8

TABLE 4-2

| | Treatment load $m^2$/L | | | | | | | | | |
|---|---|---|---|---|---|---|---|---|---|---|
| | 5.5 | 6.0 | 6.5 | 7.0 | 7.5 | 8.0 | 8.5 | 9.0 | 9.5 | 10.0 |
| Zr coating weight mg/$m^2$ | 4.8 | 5.4 | 3.9 | 3.1 | 3.7 | 3.6 | 3.6 | 2.7 | 3.2 | 4.0 |
| Appearance of treatment solution | Cloudy | Cloudy | Cloudy | Cloudy | Cloudy | Cloudy | Cloudy | Cloudy | Cloudy | Cloudy |

<Example Test 1>

A metal surface treatment solution having a Zr concentration of 1,500 mg/L (supply source: $H_2ZrF_6$), an HF concentration of 150 mg/L and an $H_2SO_4$ concentration of 8,000 mg/L (total F concentration in the metal surface treatment solution: 2,025 mg/L; pH: 3.5; total amount: 10 L) was heated to 50° C., and a Ti/Pt electrode and a sample of the testing material (1) were used as the anode and the cathode, respectively, to carry out electrolytic treatment at 0.5 A/$dm^2$ for 5 seconds (the sample was immersed in the cell as a current was applied thereto) to thereby obtain a surface-treated steel sheet in which a chemical conversion coating having a Zr coating weight of about 10 mg/$m^2$ was formed. Next, a replenisher composed of $H_2ZrF_6$ and $Zr_2(CO_3)(OH)_2O_2$ and having a Zr concentration of 25 g/L and an $M_F/M_{Zr}$ ratio of 3.1 (solvent: water) was used to replenish so as to maintain the Zr concentration and the total F concentration in the metal surface treatment solution. Then, a new sample of the testing material (1) was prepared and a series of operations for carrying out the foregoing electrolytic treatment and its subsequent replenishment was repeated. The Zr coating weight and the appearance of the metal surface treatment solution with respect to the treatment load scaled in increments of 0.5 $m^2$/L are shown in Table 5.

The amount of metal surface treatment solution transferred when a sample of the testing material (1) was taken out from the metal surface treatment solution after electrolytic treatment was carried out once was adjusted to be 5.5 mL/$m^2$ and the replenisher and/or water was added so that the total amount of the replenished metal surface treatment solution was constant.

The replenisher was prepared through the steps (1) and (3) in the above-described replenisher production method.

TABLE 9

| TABLE 5-1 | | | | | | | | | | | |
|---|---|---|---|---|---|---|---|---|---|---|---|
| | Treatment load $m^2/L$ | | | | | | | | | | |
| | 0.0 | 0.5 | 1.0 | 1.5 | 2.0 | 2.5 | 3.0 | 3.5 | 4.0 | 4.5 | 5.0 |
| Zr coating weight $mg/m^2$ | 10.1 | 10.4 | 9.7 | 10.5 | 9.6 | 9.4 | 10.2 | 10.3 | 10.2 | 9.6 | 9.9 |
| Appearance of treatment solution | Trans-parent | Trans-parent | Trans-parent | Trans-parent | Trans-parent | Trans-parent | Trans-parent | Trans-parent | Trans-parent | Trans-parent | Trans-parent |

TABLE 10

| TABLE 5-2 | | | | | | | | | | |
|---|---|---|---|---|---|---|---|---|---|---|
| | Treatment load $m^2/L$ | | | | | | | | | |
| | 5.5 | 6.0 | 6.5 | 7.0 | 7.5 | 8.0 | 8.5 | 9.0 | 9.5 | 10.0 |
| Zr coating weight $mg/m^2$ | 10.3 | 9.9 | 9.4 | 10.2 | 10.5 | 9.8 | 10.2 | 9.9 | 10.4 | 10.0 |
| Appearance of treatment solution | Trans-parent | Trans-parent | Trans-parent | Trans-parent | Trans-parent | Trans-parent | Trans-parent | Trans-parent | Trans-parent | Trans-parent |

<Example Test 2>

A metal surface treatment solution having a Zr concentration of 500 mg/L (supply source: $H_2ZrF_6$), an HF concentration of 75 mg/L and an $HNO_3$ concentration of 4,000 mg/L (total F concentration in the metal surface treatment solution: 700 mg/L; pH: 3.5; total amount: 10 L) was heated to 50° C., and a Ti/Pt electrode and a sample of the testing material (1) were used as the anode and the cathode, respectively, to carry out electrolytic treatment at 0.5 $A/dm^2$ for 7 seconds (the sample was immersed in the cell as a current was applied thereto) to thereby obtain a surface-treated steel sheet in which a chemical conversion coating having a Zr coating weight of about 10 $mg/m^2$ was formed. Next, a replenisher composed of $H_2ZrF_6$ and $ZrO(NO_3)_2$ and having a Zr concentration of 20 g/L and an $M_F/M_{Zr}$ ratio of 1.1 (solvent: water) was used to replenish so as to maintain the Zr concentration and the total F concentration in the metal surface treatment solution. Then, a new sample of the testing material (1) was prepared and a series of operations for carrying out the foregoing electrolytic treatment and its subsequent replenishment was repeated. The Zr coating weight and the appearance of the metal surface treatment solution with respect to the treatment load scaled in increments of 0.5 $m^2/L$ are shown in Table 6.

The amount of metal surface treatment solution transferred when a sample of the testing material (1) was taken out from the metal surface treatment solution after electrolytic treatment was carried out once was adjusted to be 3 $mL/m^2$ and the replenisher and/or water was added so that the total amount of the replenished metal surface treatment solution was kept constant.

The replenisher was prepared through the steps (1) to (3) in the above-described replenisher production method.

TABLE 11

| TABLE 6-1 | | | | | | | | | | | |
|---|---|---|---|---|---|---|---|---|---|---|---|
| | Treatment load $m^2/L$ | | | | | | | | | | |
| | 0.0 | 0.5 | 1.0 | 1.5 | 2.0 | 2.5 | 3.0 | 3.5 | 4.0 | 4.5 | 5.0 |
| Zr coating weight $mg/m^2$ | 9.6 | 9.7 | 10.7 | 10.5 | 9.8 | 10.2 | 10.8 | 11.0 | 9.7 | 9.7 | 10.2 |
| Appearance of treatment solution | Trans-parent | Trans-parent | Trans-parent | Trans-parent | Trans-parent | Trans-parent | Trans-parent | Trans-parent | Trans-parent | Trans-parent | Trans-parent |

TABLE 12

| TABLE 6-2 | | | | | | | | | | |
|---|---|---|---|---|---|---|---|---|---|---|
| | Treatment load $m^2/L$ | | | | | | | | | |
| | 5.5 | 6.0 | 6.5 | 7.0 | 7.5 | 8.0 | 8.5 | 9.0 | 9.5 | 10.0 |
| Zr coating weight $mg/m^2$ | 10.1 | 9.8 | 10.6 | 10.0 | 10.1 | 10.8 | 10.8 | 10.6 | 10.7 | 10.5 |

TABLE 12-continued

| TABLE 6-2 | | | | | | | | | | |
|---|---|---|---|---|---|---|---|---|---|---|
| | Treatment load $m^2/L$ | | | | | | | | | |
| | 5.5 | 6.0 | 6.5 | 7.0 | 7.5 | 8.0 | 8.5 | 9.0 | 9.5 | 10.0 |
| Appearance of treatment solution | Trans-parent | Trans-parent | Trans-parent | Trans-parent | Trans-parent | Trans-parent | Trans-parent | Trans-parent | Trans-parent | Trans-parent |

<Example Test 3>

A metal surface treatment solution having a Zr concentration of 500 mg/L (supply source: $H_2ZrF_6$), an HF concentration of 75 mg/L and an $H_2SO_4$ concentration of 4,000 mg/L (total F concentration in the metal surface treatment solution: 700 mg/L; pH: 3.5; total amount: 10 L) was heated to 50° C. and a Ti/Pt electrode and a sample of the testing material (2) were used as the anode and the cathode, respectively, to carry out electrolytic treatment at 0.5 $A/dm^2$ for 7 seconds (the sample was immersed in the cell as a current was applied thereto) to thereby obtain a surface-treated steel sheet in which a chemical conversion coating having a Zr coating weight of about 10 $mg/m^2$ was formed. Next, a replenisher composed of $H_2ZrF_6$ and $ZrOSO_4$ and having a Zr concentration of 30 g/L and an $M_F/M_{Zr}$ ratio of 1.6 (solvent:water) was used to replenish so as to maintain the Zr concentration and the total F concentration in the metal surface treatment solution. Then, a new sample of the testing material (1) was prepared and a series of operations for carrying out the foregoing electrolytic treatment and its subsequent replenishment was repeated. The Zr coating weight and the appearance of the metal surface treatment solution with respect to the treatment load scaled in increments of 0.5 $m^2/L$ are shown in Table 7.

The amount of metal surface treatment solution transferred when a sample of the testing material (2) was taken out from the metal surface treatment solution after electrolytic treatment was carried out once was adjusted to be 5 $mL/m^2$ and the replenisher and/or water was added so that the total amount of the replenished metal surface treatment solution was constant.

The replenisher was prepared through the steps (1) to (3) in the above-described replenisher production method.

TABLE 13

| TABLE 7-1 | | | | | | | | | | | |
|---|---|---|---|---|---|---|---|---|---|---|---|
| | Treatment load $m^2/L$ | | | | | | | | | | |
| | 0.0 | 0.5 | 1.0 | 1.5 | 2.0 | 2.5 | 3.0 | 3.5 | 4.0 | 4.5 | 5.0 |
| Zr coating weight $mg/m^2$ | 10.0 | 10.3 | 10.3 | 9.6 | 11.0 | 9.9 | 9.4 | 9.3 | 10.2 | 9.7 | 10.8 |
| Appearance of treatment solution | Trans-parent | Trans-parent | Trans-parent | Trans-parent | Trans-parent | Trans-parent | Trans-parent | Trans-parent | Trans-parent | Trans-parent | Trans-parent |

TABLE 14

| TABLE 7-2 | | | | | | | | | | |
|---|---|---|---|---|---|---|---|---|---|---|
| | Treatment load $m^2/L$ | | | | | | | | | |
| | 5.5 | 6.0 | 6.5 | 7.0 | 7.5 | 8.0 | 8.5 | 9.0 | 9.5 | 10.0 |
| Zr coating weight $mg/m^2$ | 9.3 | 11.0 | 10.6 | 9.5 | 9.6 | 10.7 | 9.1 | 9.4 | 10.0 | 9.4 |
| Appearance of treatment solution | Trans-parent | Trans-parent | Trans-parent | Trans-parent | Trans-parent | Trans-parent | Trans-parent | Trans-parent | Trans-parent | Trans-parent |

<Example Test 4>

A metal surface treatment solution having a Zr concentration of 500 mg/L (supply source: $H_2ZrF_6$), an HF concentration of 75 mg/L and an $HNO_3$ concentration of 4,000 mg/L (total F concentration in the metal surface treatment solution: 700 mg/L; pH: 3.5; total amount: 10 L) was heated to 50° C., and a Ti/Pt electrode and a sample of the testing material (2) were used as the anode and the cathode, respectively, to carry out electrolytic treatment at 0.5 A/dm$^2$ for 7 seconds (the sample was immersed in the cell as a current was applied thereto) to thereby obtain a surface-treated steel sheet in which a chemical conversion coating having a Zr coating weight of about 10 mg/m$^2$ was formed. Next, a replenisher composed of $H_2ZrF_6$ and $ZrO(C_2H_3O_2)_2$ and having a Zr concentration of 40 g/L and an $M_F/M_{Zr}$ ratio of 2.1 (solvent: water) was used to replenish so as to maintain the Zr concentration and the total F concentration in the metal surface treatment solution. Then, a new sample of the testing material (2) was prepared and a series of operations for carrying out the foregoing electrolytic treatment and its subsequent replenishment was repeated. The Zr coating weight and the appearance of the metal surface treatment solution with respect to the treatment load scaled in increments of 0.5 m$^2$/L are shown in Table 8.

The amount of metal surface treatment solution transferred when a sample of the testing material (2) was taken out from the metal surface treatment solution after electrolytic treatment was carried out once was adjusted to be 8 mL/m$^2$ and the replenisher and/or water was added so that the total amount of the replenished metal surface treatment solution was constant.

The replenisher was prepared through the steps (1) to (3) in the above-described replenisher production method.

<Example Test 5>

A metal surface treatment solution having a Zr concentration of 500 mg/L (supply source: $H_2ZrF_6$), an HF concentration of 75 mg/L and an $HNO_3$ concentration of 4,000 mg/L (total F concentration in the metal surface treatment solution: 700 mg/L; pH: 3.5; total amount: 10 L) was heated to 50° C., and a Ti/Pt electrode and a sample of the testing material (3) or (4) were used as the anode and the cathode, respectively, to carry out electrolytic treatment at 0.5 A/dm$^2$ for 7 seconds (the sample was immersed in the cell as a current was applied thereto) to thereby obtain a surface-treated steel sheet in which a chemical conversion coating having a Zr coating weight of about 10 mg/m$^2$ was formed. Next, a replenisher composed of $H_2ZrF_6$ and $Zr_2(CO_3)(OH)_2O_2$ and having a Zr concentration of 25 g/L and an $M_F/M_{Zr}$ ratio of 3.0 (solvent: water) was used to replenish so as to keep the Zr concentration and the total F concentration in the metal surface treatment solution. Then, a new sample of the testing material (3) or (4) was prepared and a series of operations for carrying out the foregoing electrolytic treatment and its subsequent replenishment was repeated. The Zr coating weight and the appearance of the metal surface treatment solution with respect to the treatment load scaled in increments of 0.5 m$^2$/L in the case of using the samples of the testing material (3) are shown in Table 9.

The amount of metal surface treatment solution transferred when a sample of the testing material (3) or (4) was taken out from the metal surface treatment solution after electrolytic treatment was carried out once was adjusted to be 14 mL/m$^2$ and the replenisher and/or water was added so that the total amount of the replenished metal surface treatment solution was constant.

TABLE 15

TABLE 8-1

| | Treatment load m$^2$/L | | | | | | | | | | |
|---|---|---|---|---|---|---|---|---|---|---|---|
| | 0.0 | 0.5 | 1.0 | 1.5 | 2.0 | 2.5 | 3.0 | 3.5 | 4.0 | 4.5 | 5.0 |
| Zr coating weight mg/m$^2$ | 10.2 | 9.2 | 9.5 | 10.5 | 10.7 | 9.5 | 10.5 | 9.3 | 9.1 | 9.9 | 9.1 |
| Appearance of treatment solution | Transparent | Transparent | Transparent | Transparent | Transparent | Transparent | Transparent | Transparent | Transparent | Transparent | Transparent |

TABLE 16

TABLE 8-2

| | Treatment load m$^2$/L | | | | | | | | | |
|---|---|---|---|---|---|---|---|---|---|---|
| | 5.5 | 6.0 | 6.5 | 7.0 | 7.5 | 8.0 | 8.5 | 9.0 | 9.5 | 10.0 |
| Zr coating weight mg/m$^2$ | 9.9 | 10.7 | 10.2 | 9.2 | 10.8 | 9.4 | 10.1 | 10.9 | 10.7 | 10.0 |
| Appearance of treatment solution | Transparent | Transparent | Transparent | Transparent | Transparent | Transparent | Transparent | Transparent | Transparent | Transparent |

The replenisher was prepared through the steps (1) and (3) in the above-described replenisher production method.

Also in the case of using the samples of the testing material (4), the Zr coating weight was approximately constant even when the treatment load increased and the appearance of the metal surface treatment solution was also transparent, as in Table 9.

TABLE 17

TABLE 9-1

| | Treatment load $m^2/L$ | | | | | | | | | | |
|---|---|---|---|---|---|---|---|---|---|---|---|
| | 0.0 | 0.5 | 1.0 | 1.5 | 2.0 | 2.5 | 3.0 | 3.5 | 4.0 | 4.5 | 5.0 |
| Zr coating weight $mg/m^2$ | 9.7 | 9.2 | 9.8 | 10.1 | 9.1 | 10.7 | 10.7 | 9.6 | 10.6 | 9.6 | 9.4 |
| Appearance of treatment solution | Trans-parent | Trans-parent | Trans-parent | Trans-parent | Trans-parent | Trans-parent | Trans-parent | Trans-parent | Trans-parent | Trans-parent | Trans-parent |

TABLE 18

TABLE 9-2

| | Treatment load $m^2/L$ | | | | | | | | | |
|---|---|---|---|---|---|---|---|---|---|---|
| | 5.5 | 6.0 | 6.5 | 7.0 | 7.5 | 8.0 | 8.5 | 9.0 | 9.5 | 10.0 |
| Zr coating weight $mg/m^2$ | 9.9 | 9.8 | 10.0 | 10.1 | 10.2 | 9.3 | 9.0 | 10.0 | 9.7 | 9.4 |
| Appearance of treatment solution | Trans-parent | Trans-parent | Trans-parent | Trans-parent | Trans-parent | Trans-parent | Trans-parent | Trans-parent | Trans-parent | Trans-parent |

<Example Test 6>

A metal surface treatment solution having a Zr concentration of 500 mg/L (supply source: $H_2ZrF_6$), an HF concentration of 75 mg/L and an $HNO_3$ concentration of 4,000 mg/L (total F concentration in the metal surface treatment solution: 700 mg/L; pH: 3.5; total amount: 10 L) was heated to 50° C., and a Ti/Pt electrode and a sample of the testing material (3) or (4) were used as the anode and the cathode, respectively, to carry out electrolytic treatment at 0.5 $A/dm^2$ for 7 seconds (the sample was immersed in the cell as a current was applied thereto) to thereby obtain a surface-treated steel sheet in which a chemical conversion coating having a Zr coating weight of about 10 $mg/m^2$ was formed. Next, a replenisher composed of $H_2ZrF_6$ and $Zr_2(CO_3)(OH)_2O_2$ and having a Zr concentration of 25 g/L and an $M_F/M_{Zr}$ ratio of 3.5 (solvent: water) was used to replenish so as to maintain the Zr concentration and the total F concentration in the metal surface treatment solution. Then, a new sample of the testing material (3) or (4) was prepared and a series of operations for carrying out the foregoing electrolytic treatment and its subsequent replenishment was repeated. The Zr coating weight and the appearance of the metal surface treatment solution with respect to the treatment load scaled in increments of 0.5 $m^2/L$ in the case of using the samples of the testing material (3) are shown in Table 10.

The amount of metal surface treatment solution transferred when a sample of the testing material (3) or (4) was taken out from the metal surface treatment solution after electrolytic treatment was carried out once was adjusted to be 20 $mL/m^2$ and the replenisher and/or water was added so that the total amount of the replenished metal surface treatment solution was kept constant.

The replenisher was prepared through the steps (1) and (3) in the above-described replenisher production method.

Also in the case of using the samples of the testing material (4), the Zr coating weight was approximately constant even when the treatment load increased and the appearance of the metal surface treatment solution was also transparent, as in Table 10.

TABLE 19

TABLE 10-1

| | Treatment load $m^2/L$ | | | | | | | | | | |
|---|---|---|---|---|---|---|---|---|---|---|---|
| | 0.0 | 0.5 | 1.0 | 1.5 | 2.0 | 2.5 | 3.0 | 3.5 | 4.0 | 4.5 | 5.0 |
| Zr coating weight $mg/m^2$ | 10.2 | 9.1 | 9.4 | 10.2 | 9.5 | 9.6 | 9.1 | 9.6 | 9.3 | 9.6 | 9.3 |
| Appearance of treatment solution | Trans-parent | Trans-parent | Trans-parent | Trans-parent | Trans-parent | Trans-parent | Trans-parent | Trans-parent | Trans-parent | Trans-parent | Trans-parent |

TABLE 20

TABLE 10-2

| | Treatment load $m^2/L$ | | | | | | | | | |
|---|---|---|---|---|---|---|---|---|---|---|
| | 5.5 | 6.0 | 6.5 | 7.0 | 7.5 | 8.0 | 8.5 | 9.0 | 9.5 | 10.0 |
| Zr coating weight $mg/m^2$ | 10.9 | 10.4 | 9.4 | 10.8 | 9.1 | 9.9 | 9.7 | 10.1 | 9.1 | 9.1 |
| Appearance of treatment solution | Trans-parent | Trans-parent | Trans-parent | Trans-parent | Trans-parent | Trans-parent | Trans-parent | Trans-parent | Trans-parent | Trans-parent |

As is seen from Table 1 showing the results of Comparative Test 1, without replenishment of the metal surface treatment solution, the Zr concentration in the metal surface treatment solution decreases and HF is produced as a by-product with the deposition of a Zr film and stabilizes Zr ions, which hinders film deposition under the same electrolytic conditions. As is seen from Table 2 showing the results of Comparative Test 2, as a result of the supply of $H_2ZrF_6$ for the consumed Zr, the Zr ion concentration is kept at a constant level but an increase in the HF concentration cannot be suppressed, thus leading to considerable deterioration in the Zr coating properties.

Although theoretically it seems that $ZrO(NO_3)_2$ containing no HF enables supply of Zr ions while suppressing an increase in the HF concentration, as is seen from Table 3 showing the results of Comparative Test 3, $ZrO(NO_3)_2$ having the property of depositing at a pH of around 2.0 is deposited as soon as it is introduced into the metal surface treatment solution at a pH of 3.5. Since not only supply of Zr ions but also trapping of HF is impossible, this material does not function at all as the replenisher and hence the Zr coating properties cannot be prevented from deteriorating. As is seen from Table 4 showing the results of Comparative Test 4, even if HF and Zr are simply supplied in the form of $H_2ZrF_6$ and $ZrO(NO_3)_2$, respectively, Zr ions supplied in the form of $H_2ZrF_6$ are only effective and $ZrO(NO_3)_2$ is deposited as in Comparative Test 3. Accordingly, these materials do not function as the replenisher as above and cannot prevent the deterioration of the Zr coating properties. This suggests that the replenisher described in [0033] of Patent Literature 1 is actually not effective.

On the other hand, as is seen from Tables 5 to 10 showing the results of Example Tests 1 to 6, it was revealed that the replenisher used in each of the Example Tests has no problem on the Zr coating properties and the appearance of the treatment solution, and supply of Zr ions and trapping of HF that have not heretofore been achievable can be simultaneously carried out to maintain the metal surface treatment solution at a healthy level without drainage. In these cases, it is shown that any type of fluorine-free zirconium compound can be used if it is selected from among the above-described materials.

<Running Test>

A metal surface treatment solution having a Zr concentration of 1,500 mg/L (supply source: $H_2ZrF_6$), an HF concentration of 120 mg/L and an $HNO_3$ concentration of 8,000 mg/L (total F concentration in the metal surface treatment solution: 1,995 mg/L; pH: 3.5; total amount: 10 L) was heated to 50° C., and a Ti/Pt electrode and a sample of the testing material (3) or (4) were used as the anode and the cathode, respectively, to carry out electrolytic treatment at 0.7 $A/dm^2$ for 3 seconds (the sample was immersed in the cell as a current was applied thereto) to thereby obtain a surface-treated steel sheet in which a chemical conversion coating having a Zr coating weight of about 8 $mg/m^2$ was formed. Next, replenishers composed of $H_2ZrF_6$ and $Zr_2(CO_3)(OH)_2O_2$, having a Zr concentration of 25 g/L and also having a varying $M_F/M_{Zr}$ ratio as shown in Table 11 (solvent:water) were prepared and one of the replenishers was used to replenish so as to maintain the Zr concentration and the total F concentration in the metal surface treatment solution. Then, a series of operations including the above-described electrolytic treatment and replenishment was repeated and component variations in the metal surface treatment solution at the final treatment load of 2,500 $m^2/L$ were checked. Replenishment was carried out each time the treatment load varied by a value of 100 $m^2/L$.

Table 11 shows the results using the testing material sample (3). The same results as in Table 11 were obtained also in the case of using the testing material sample (4).

<Evaluation>

The HF concentration in the metal surface treatment solution was measured with a fluorine ion meter to check the component variations. Electrolytic treatment was carried out at 0.7 $A/dm^2$ for 3 seconds (the sample was immersed in the cell as a current was applied thereto) and the Zr coating weight was measured. From a practical point of view, no sample should be rated "poor."

(Evaluation Criteria)

Excellent: The HF concentration varies within ±10% of the HF concentration in the initial treatment solution, the Zr coating weight substantially does not change compared to that in the first electrolytic treatment, and the metal surface treatment solution was transparent.

Good: The HF concentration varies in a range exceeding ±10% but within ±30% of the HF concentration in the initial treatment solution, the Zr coating weight substantially does not change compared to that in the first electrolytic treatment, and the metal surface treatment solution was transparent.

Fair: The HF concentration varies in a range exceeding ±30% of the HF concentration in the initial treatment solution but the Zr coating weight substantially does not change compared to that in the first electrolytic treatment and the metal surface treatment solution was transparent.

Poor: The Zr coating weight cannot be kept at a specific level or the treatment solution gets cloudy.

The results of the running test are shown in Table 11. Table 11 reveals that the replenisher is excellent in the Zr coating weight and the treatment solution stability at an $M_F/M_{Zr}$ ratio of less than 4.0. It is also revealed that it is possible to make the HF concentration in the metal surface treatment solution constant and to obtain a sufficient Zr coating weight at an $M_F/M_{Zr}$ ratio of 2.8 to 3.2.

Since the mixed solution of hexafluorozirconic acid and zirconium nitrate as described in paragraph [0033] of Patent Literature 1 (JP 2009-84623 A) has an $M_F/M_{Zr}$ ratio of 4.0, the replenisher does not achieve the desired effects as shown in Table 11.

TABLE 21

TABLE 11

| | $M_F/M_{Zr}$ | | | | | | | | | | |
|---|---|---|---|---|---|---|---|---|---|---|---|
| | 1.60 | 1.90 | 2.40 | 2.80 | 3.00 | 3.20 | 3.40 | 3.64 | 3.80 | 4.00 | 4.30 |
| Evaluation | Fair | Good | Good | Excellent | Excellent | Excellent | Good | Good | Good | Poor | Poor |

It is revealed from the above that, by using the replenisher of the invention, variations in the composition of the metal surface treatment solution can be suppressed without drainage while maintaining the Zr coating properties and the appearance properties of the metal surface treatment solution.

The invention claimed is:

1. A replenisher for use in supplying zirconium ions to a metal surface treatment solution which contains zirconium ions and fluorine ions and which is used to form, on a surface of a steel sheet, a zirconium-containing chemical conversion coating through electrolytic treatment, comprising:

(A) hexafluorozirconic acid or a salt thereof; and/or (B) hydrofluoric acid or a salt thereof; and (C) a fluorine-free zirconium compound, wherein a total concentration (g/L) of the zirconium ions derived from the hexafluorozirconic acid or a salt thereof (A) and the fluorine-free zirconium compound (C) is at least 20, wherein a ratio ($M_F/M_{Zr}$) of a total molar quantity of the fluorine ions ($M_F$) derived from the hexafluorozirconic acid or a salt thereof (A) and the hydrofluoric acid or a salt thereof (B) to a total molar quantity of the zirconium ions ($M_{Zr}$) derived from the hexafluorozirconic acid or a salt thereof (A) and the fluorine-free zirconium compound (C) is 0.01 or more but less than 4.00, and the replenisher has a pH of 0 to 1.5.

2. The replenisher according to claim 1, wherein the fluorine-free zirconium compound (C) is at least one selected from the group consisting of zirconium oxynitrate, zirconium oxysulfate, zirconium acetate, zirconium hydroxide, and basic zirconium carbonates.

3. A method for producing a surface-treated steel sheet comprising: continuously electrolyzing a steel sheet in a metal surface treatment solution containing zirconium ions and fluorine ions to form a zirconium-containing chemical conversion coating on the steel sheet, wherein the replenisher according to claim 1 is added to the metal surface treatment solution to supply zirconium ions.

4. A method for producing a surface-treated steel sheet comprising: continuously electrolyzing a steel sheet in a metal surface treatment solution containing zirconium ions and fluorine ions to form a zirconium-containing chemical conversion coating on the steel sheet, wherein the replenisher according to claim 2 is added to the metal surface treatment solution to supply zirconium ions.

5. The replenisher according to claim 1, wherein the ratio ($M_F/M_{Zr}$) is 2.8-3.2.

6. The replenisher according to claim 1, wherein the ratio ($M_F/M_{Zr}$) is from 1.9 to less than 4.00.

* * * * *